US006810811B2

(12) United States Patent
Grounds et al.

(10) Patent No.: US 6,810,811 B2
(45) Date of Patent: Nov. 2, 2004

(54) METHOD OF MANUFACTURING AN ITEM OF PRINTED INDICIA

(76) Inventors: Chad Grounds, 713 Sandy Trail, Ft. Worth, TX (US) 76120; Ben R. Lawrence, 2200 Oak Forest Ct., Arlington, TX (US) 76012

( * ) Notice: Subject to any disclaimer, the term of this patent is extended or adjusted under 35 U.S.C. 154(b) by 0 days.

(21) Appl. No.: 10/247,131

(22) Filed: Sep. 19, 2002

(65) Prior Publication Data

US 2004/0055482 A1 Mar. 25, 2004

(51) Int. Cl.[7] ..... B41F 1/34
(52) U.S. Cl. ..... 101/485; 101/35
(58) Field of Search ..... 101/35, 114, 115, 101/116, 119, 120, 129, 484, 485

(56) References Cited

U.S. PATENT DOCUMENTS 1,870,825 A * 8/1932 Sprague ..... 101/493
2,037,254 A * 4/1936 Miller ..... 101/493
2,294,342 A * 8/1942 O'Leary ..... 40/446
3,613,679 A * 10/1971 Bijou ..... 602/75
3,701,315 A * 10/1972 Maund ..... 101/37
4,437,408 A * 3/1984 Arkans ..... 101/483
4,532,850 A 8/1985 Peham ..... 84/173
4,989,508 A 2/1991 King ..... 101/35
5,113,757 A 5/1992 Spencer ..... 101/35
5,165,336 A 11/1992 Spencer ..... 101/35
5,674,067 A 10/1997 Masel ..... 433/24
5,894,032 A * 4/1999 Green et al. ..... 427/2.31
5,945,060 A 8/1999 Williams ..... 264/564

* cited by examiner

*Primary Examiner*—Ren Yan
(74) *Attorney, Agent, or Firm*—Bracewell & Patterson LLP

(57) ABSTRACT

A method of manufacturing an item of printed indicia is shown. A rubber band is provided which is stretchable between a relaxed state and an extended state and having a first exposed surface. The elastic substrate is stretched to the extended state and placed onto a form to maintain the substrate in the extended state. A primary indicia is then printed upon the first exposed surface of the elastic substrate. The primary indicia is readable to an observer when the substrate is in the extended state but is unreadable when the substrate is returned to the relaxed state. The elastic substrate can then be removed from the form and allowed to return to the relaxed state. The band can be worn about the limb of a user with the primary indicia forming a hidden message which is revealed to an observer when the substrate is stretched to the extended state.

11 Claims, 2 Drawing Sheets

METHOD OF MANUFACTURING AN ITEM OF PRINTED INDICIA

BACKGROUND OF THE INVENTION

1. Field of the Invention

The present invention relates generally to manufacture of elastic bands and, more specifically, to printed elastic bands which bear printed indicia including advertising indicia.

2. Description of the Related Art

Elastic bands may be made according to the methods described in U.S. Pat. Nos. 2,781,550; 3,787,552 and others. In the methods shown in these prior art references, elastomeric tubes are extruded, cured and cut into bands.

U.S. Pat. No. 5,165,336 shows a method for printing rubber bands of the type produced by the above references. Printed elastic bands are made by piercing, evacuating and flattening an elastic tubing followed by washing, scrubbing and drying the upper surface of the tubing. The tubing is aligned on a conveyor and moved upward toward a printing head and quickly downward away from the printing head while maintaining the tubing in a flattened state. The printing is devolatilized and cured while the tubing continues to move a cut-off point. Nip rollers drive a tubing on to a cut-off platen. A final roller near the edge of the platen has a higher surface feed than the nip rollers to flatten the tubing. Printing on the tubing is sensed and rotating knives are sensed and the speed of the nip rollers is controlled to cut the tubing between the printed areas. Severed printed bands are removed by vacuum and are discharged from a cyclone separator.

While the above and other prior art references teach various methods for printing upon elastic bands, the printing was not generally done on stretched rubber, i.e., while the band was in a stretched state.

A need exists for a method of manufacturing an item of printed indicia in which printing is imparted to a stretched elastomeric band whereby the printing is readable and intelligible when the band is in the stretched state but is unintelligible when the band returns to the relaxed state.

A need exists for a method for imparting printed indicia to a stretched elastomeric substrate which is simple to implement and economical in operation.

SUMMARY OF THE INVENTION

A method is shown for manufacturing an item of printed indicia. An elastic substrate is provided which is stretchable between a relaxed state and an extended state. The elastic substrate has a first exposed surface. The elastic substrate is stretched to the extended state. The stretched substrate is then placed onto a form or mandrel to maintain the substrate in the extended state. A primary indicia is then printed upon the first exposed surface of the elastic substrate. The primary indicia is readable to an observer when the substrate is in the extended state but is unreadable when the substrate is returned to the relaxed state. The substrate is then removed from the form so that the substrate returns to the relaxed state.

Preferably, the elastic substrate is pre-printed with a secondary indicia upon the first exposed surface which is readable by an observer when the substrate is in the relaxed state as well as when the substrate is in the extended state. In the most preferred form, the elastic substrate is a rubber band which is stretched around a mandrel in order to maintain the rubber band in the extended state for printing the primary indicia thereon. A plurality of rubber bands can be stretched around a common mandrel with the plurality of bands being printed with the primary indicia in a single printing step.

An article of printed indicia is provided which includes an elastic substrate stretchable between a relaxed state and an extended state, the elastic substrate having a first exposed surface. The first exposed surface bears a printed indicia thereon which is readable when the elastic substrate is in the extended state and which is unreadable when the elastic substrate is in the relaxed state. In the preferred form, the elastic substrate is a rubber band which is worn about a limb of a user such as around the user's wrist or arm. The printed indicia is preferably an advertising message which is readable by an observer when the band is stretched by the user and which is unreadable by an observer when the band is in a relaxed state about the limb of the user.

Additional objects, features and advantages will be apparent in the written description witch follows.

DETAILED DESCRIPTION OF THE PREFERRED EMBODIMENTS

Figure 1:
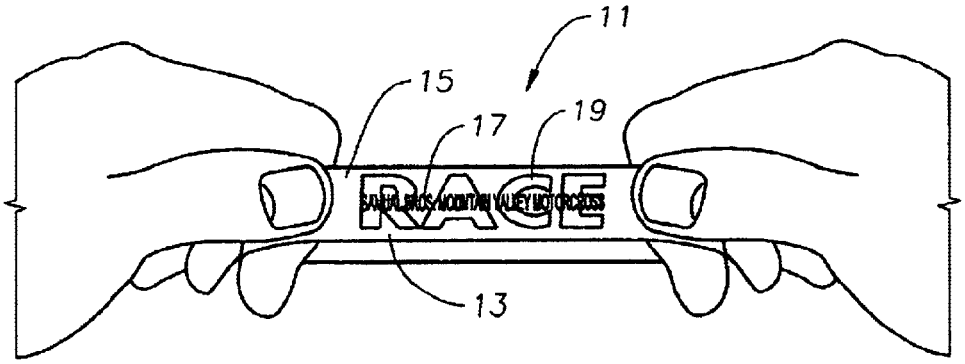
FIG. 1 is a front view of a rubber band of the invention in the relaxed state showing the readable secondary indicia and the unreadable primary indicia.

Turning to FIG. 1, there is shown an article of printed indicia made through the manufacturing method of the invention, the article being designated generally as 11. The article is formed from an elastic substrate, in this case rubber band 13, which is stretchable between the relaxed state shown in FIG. 1 and an extended state shown in FIG. 2. The elastic substrate 13 has a first exposed surface shown generally at 15 in FIGS. 1 and 2.

Figure 2:
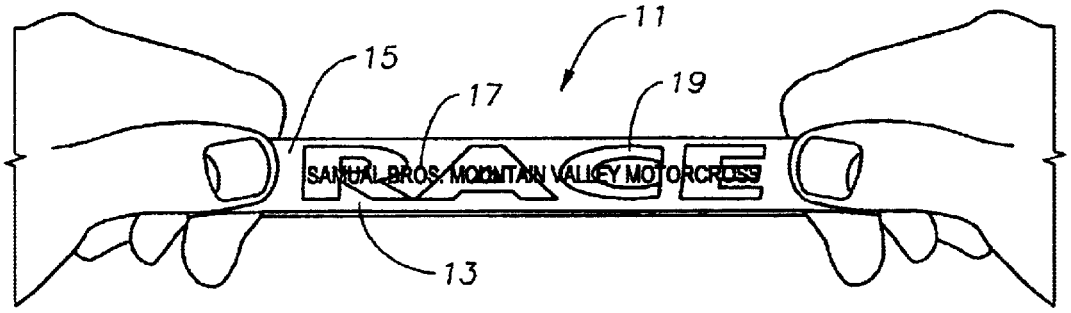
FIG. 2 is a view of the rubber band of FIG. 1 in the extended state, the primary indicia now being readable.
Figure 3:
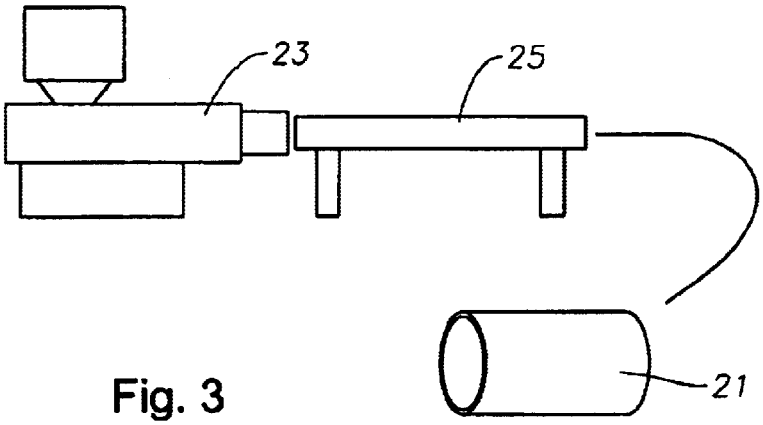
FIG. 3 is a simplified, schematic view of a manufacturing process used to produce an elastomeric tube used in manufacturing the elastomeric bands of the invention.

As shown in FIGS. 1 and 2, the first exposed surface 15 bears a primary printed indicia 17 thereon which is readable when the elastic substrate is in the extended state shown in FIG. 2 but which is unreadable when the band is in the relaxed state shown in FIG. 1.

Preferably, the first exposed surface 15 of the elastic substrate also bears a pre-printed secondary indicia 19 thereon which is readable by an observer when the substrate is in the relaxed state as well as when the substrate is in the extended state. In one form of the invention, at least the secondary indicia bears an advertising message.

Figure 4:
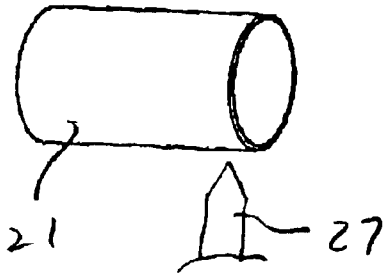
FIG. 4 is a simplified view of a subsequent manufacturing step in which the rubber tube is cut into individual bands.

FIGS. 3–6 illustrate the manufacturing method used to produce the item of printed indicia shown in FIGS. 1 and 2. In the first step of the method shown in FIG. 3, an elastomeric substrate or tube 21 is extruded from the rubber extruder 23 and cooled in a cooling bath 25. As shown in FIG. 4, the elastomeric tube 21 contacts nip rollers 27 which are used to cut the tube into a plurality of continuous strips or bands.

Figure 5:
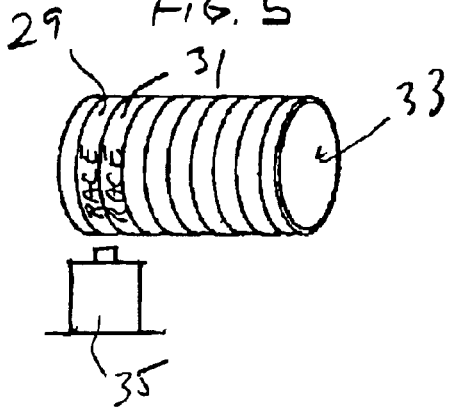
FIG. 5 illustrates a further step in the manufacturing process in which the secondary indicia is printed onto the bands with the bands in the generally relaxed state.

As shown in FIG. 5, the plurality of bands 29, 31 are carried on a mandrel 33 and have the secondary indicia printed thereon, for example by the print head 35.

The steps illustrated in manufacturing bands with the secondary printed indicia are conventional commercial processes as described, for example, in the previously mentioned U.S. Pat. No. 5,165,336, to Spencer, issued Nov. 24, 1992. Other conventional processes for printing bands with the secondary indicia exists, as well.

Figure 6:
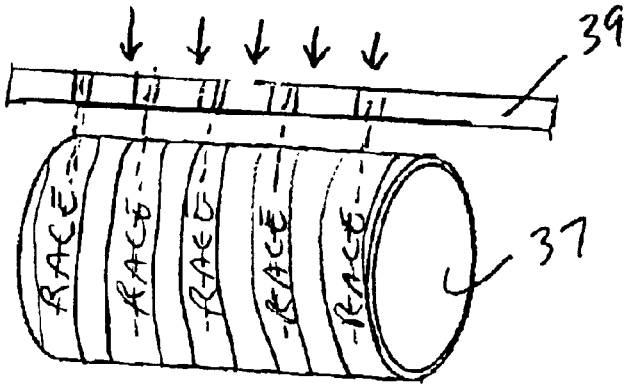
FIG. 6 is a further view of the manufacturing process of the invention in which the primary indicia is printed upon the elastomeric bands with the bands in the extended state.

In the steps of the method illustrated in FIG. 6, the elastic bands are stretched to the extended state and are placed onto a form or mandrel, illustrated as 37. The mandrel 37 is of a larger diameter than the print mandrel 33 so that the bands are maintained in the extended state. The primary indicia can then be printed upon the first exposed surfaces of the rubber bands in any convenient fashion. In the illustration of FIG. 6, ink is applied by means of a silk screen 39 with a plurality of bands being printed with the primary indicia in a single step. Since the bands are in the extended state during the printing operation of FIG. 6, the primary indicia is readable to an observer with the substrate in the extended state but is unreadable when the substrate returns to the relaxed state. Thus, when the bands are removed from the form 37 and returned to the relaxed state, they will have the general appearance of the completed and printed bands shown in FIG. 1.

An invention has been provided with several advantages. The method for applying a printed indicia to a rubber band of the invention provides a novel means for imparting an advertising indicia to a rubber band. The band can easily be worn about a limb such as the wrist or arm of a user and can be sized to remain in the substantially relaxed state when about the user's limb. As the band is stretched as shown in FIG. 2, the primary indicia become observable allowing the observer to read the otherwise hidden message. The band can also be pre-printed with a secondary printed indicia which is readable with the band in the generally relaxed state so that the advertising message is imparted on two different levels to the observer. The method can utilize bands which are previously cut and pre-printed with the secondary indicia. The technique for applying the primary "hidden" indicia is simple to accomplish and economical.

While the invention has been shown in only one of its forms, it is not thus limited, but is susceptible to various changes and modifications without departing from the spirit thereof.

What is claimed is:

1. A method of manufacturing an item of printed indicia, the method comprising:

providing an elastic substrate which is stretchable between a relaxed state and an extended state, the elastic substrate having exposed surface;

stretching the elastic substrate to the extended state;

placing the stretched substrate onto a form to maintain the substrate in the extended state;

printing a first subject matter upon the exposed surface of the elastic substrate while the substrate is in the extended state, the first subject matter being discernable to an observer when the substrate is in the extended state and being undiscernable when the substrate is returned to the relaxed state; and printing a second subject matter on the exposed surface while the substrate is in the relaxed state, the second subject matter being discernable by an observer when the substrate is in the relaxed states as well as when the substrate is in the extended state.

2. The method of claim 1, wherein the elastic substrate is a rubber band which is stretched around a mandrel in order to maintain the rubber band in the extended state.

3. The method of claim 2, wherein a plurality of rubber bands are stretched around a mandrel, the plurality of bands being printed with the first subject matter in a single printing step.

4. The method of claim 3, wherein the first subject matter is applied to the plurality of bands by a screen printing technique.

5. The method of claim 1, wherein the subject matters printed are superimposed on each other.

6. The method of claim 1, wherein each of the subject matters printed comprises a lettering.

7. The method of claim 5, if wherein the second subject matter printed has a lettering font of greater size than the lettering font of the first subject matter printed.

8. A method of manufacturing an item of printed indicia, the method comprising:

providing an elastic substrate which is stretchable between a relaxed state and an extended state, the elastic substrate having an exposed surface;

stretching the elastic substrate to the extended state;

placing the stretched substrate onto a form to maintain the substrate in the extended state;

printing an indicia upon the exposed surface of the elastic substrate while the substrate is in the extended state, the indicia being readable to an observer when the substrate is in the extended state and being unreadable when the substrate is returned to the relaxed state;

printing a subject matter on the exposed surface while the substrate is in the relaxed state, the subject matter being discernable by an observer when the substrate is in the relaxed states as well as when the substrate is in the extended state; and wherein a portion of the indicia and a portion of the subject matter are printed on the same part of the substrate.

9. The method of claim 8, wherein the indicia printed and the subject matter printed are superimposed upon each other.

10. The method of claim 8, wherein the subject matter printed comprises a lettering.

11. A method of manufacturing an item of printed indicia, the method comprising:

providing an elastic substrate which is stretchable between a relaxed state and an extended state, the elastic substrate having an exposed surface;

stretching the elastic substrate to the extended state;

placing the stretched substrate onto a form to maintain the substrate in the extended state;

printing an indicia upon the exposed surface of the elastic substrate while the substrate is in the extended state, the indicia being readable to an observer when the substrate is in the extended state and being unreadable when the substrate is returned to the relaxed state;

printing a lettering on the exposed surface while the substrate is in the relaxed state, the lettering being discernable by an observer when the substrate is in the relaxed states as well as when the substrate is in the extended state; and wherein a portion of the indicia printed and a portion of the lettering printed are superimposed upon each other on the substrate.

* * * * *